US006932425B1

(12) United States Patent
Tseng

(10) Patent No.: US 6,932,425 B1
(45) Date of Patent: Aug. 23, 2005

(54) FOLDABLE BENCH

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 11/062,372

(22) Filed: Feb. 22, 2005

(51) Int. Cl.[7] ..... A47C 4/00
(52) U.S. Cl. ..... 297/46
(58) Field of Search ..... 297/56, 55, 46, 297/16.1, 232, 452.13, 51, 52

(56) References Cited

U.S. PATENT DOCUMENTS 359,790 A * 3/1887 Knott ..... 297/55
6,092,866 A * 7/2000 Wu ..... 297/56
6,332,646 B1 * 12/2001 Tseng ..... 297/16.1
6,840,573 B1 * 1/2005 Yao ..... 297/16.1
6,848,740 B1 * 2/2005 Reese ..... 297/16.1

* cited by examiner

*Primary Examiner*—Milton Nelson, Jr.
(74) *Attorney, Agent, or Firm*—Ladas & Parry LLP

(57) ABSTRACT

A foldable bench includes a first leg frame having a first cross bar, a second leg frame connected pivotally to and intersecting the first leg frame and having a second cross bar, a backrest frame connected pivotally to and extending upwardly and rearwardly from a top end of the second leg frame, left and right toggle mechanisms, each being stretchable to move the leg frames to an unfolded position and being foldable to permit the leg frames to move to a folded position, an upper frame connected to a top end of the first leg frame proximate to the first cross bar and to a top end of the backrest frame, a supporting rod having a bottom insert end releasable from the second cross bar, and a flexible seat cushion assembly mounted on the upper frame and the first cross bar.

9 Claims, 7 Drawing Sheets

FOLDABLE BENCH

BACKGROUND OF THE INVENTION

1. Field of the Invention

The invention relates to a foldable seat, more particularly to a foldable bench.

2. Description of the Related Art

Referring to FIG. 1, a conventional bench 9 is shown to include left and right armrest support frames 91, a seat member 92 connected fixedly between the armrest support frames 91, and a backrest 93 connected fixedly between the armrest support frames 91 at rear ends thereof. The distance between the armrest support frames 91 is such that the seat member 92 can accommodate two or more persons. Because the conventional bench 9 must be able to bear the weight of at least two persons sitting on the seat member 92, the armrest support frames 91, the seat member 92 and the backrest 93 are generally designed with fixed connections for safety reasons.

However, since the conventional bench 9 cannot be folded, it occupies a substantial space during transport, and is inconvenient to move, carry, and store.

SUMMARY OF THE INVENTION

Therefore, the object of the present invention is to provide a bench that is foldable while maintaining a strong structure, thereby making the bench convenient to transport, carry, and store.

According to this invention, a foldable bench comprises a first leg frame, a second leg frame, a backrest frame, left and right toggle mechanisms, an upper frame, a supporting rod, and a flexible seat cushion assembly. The first leg frame includes a front first cross bar, and extends downwardly and rearwardly from the first cross bar. The second leg frame includes a front second cross bar disposed below the first cross bar, extends upwardly and rearwardly from the second cross bar, and is connected pivotally to and intersects the first leg frame. The backrest frame is connected pivotally to a top end of the second leg frame, and extends upwardly and rearwardly from the second leg frame. The backrest frame has a top end higher than the first cross bar. Each of the left and right toggle mechanisms is connected between the first and second leg frames, is stretchable to move the first and second leg frames to an unfolded position, and is foldable to permit the first and second leg frames to move to a folded position. The upper frame is connected to a top end of the first leg frame proximate to the first cross bar and to the top end of the backrest frame, and extends upwardly and rearwardly from the first cross bar. The supporting rod has a top pivot end connected pivotally to the first cross bar, and a bottom insert end engaged detachably to the second cross bar. The bottom insert end is releasable from the second cross bar to place the first and second leg frames in the folded position. The flexible seat cushion assembly is mounted on the upper frame and the first cross bar.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
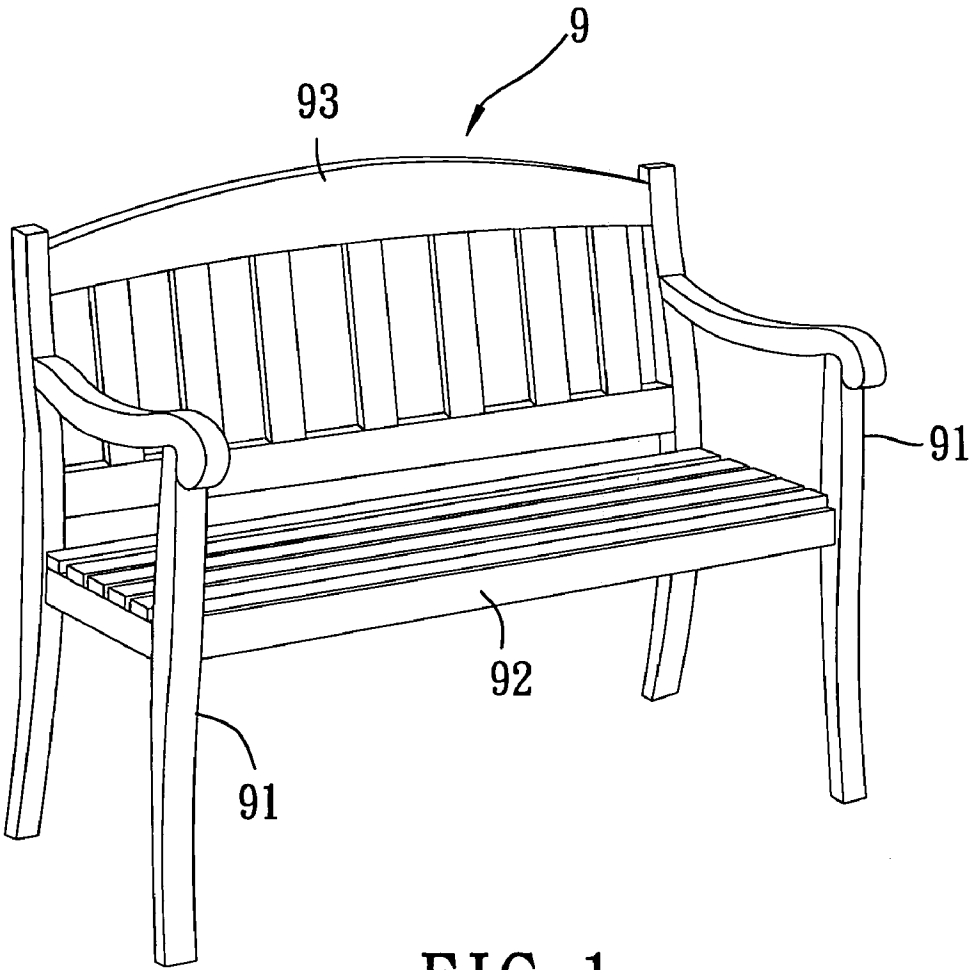
FIG. 1 PRIOR ART
FIG. 1 is a perspective view of a conventional bench.

Referring to FIGS. 2 to 7, the preferred embodiment of a foldable bench 100 according to the present invention is shown to comprise a first leg frame 1, a second leg frame 2, a backrest frame 3, left and right toggle mechanisms, an upper frame 5, a seat frame 6, a supporting rod 7, and a flexible seat cushion assembly 8.

The first leg frame 1 is substantially U-shaped, and includes a front first cross bar 12, left and right first leg members 11, each having front and rear ends, and a pivot pin 13 that projects from a central portion of the first cross bar 12 in a front-to-rear direction. The front ends of the first leg members 11 are connected respectively to two opposite ends of the first cross bar 12. The first leg members 11 extend downwardly and rearwardly from the front ends thereof, and the rear ends of the first leg members 11 are adapted to be in contact with the ground.

The second leg frame 2 is substantially U-shaped, and includes a front second cross bar 22 adapted to be disposed on the ground, and left and right second leg members 21, each having front and rear ends. The front ends of the second leg members 21 are connected respectively to two opposite ends of the second cross bar 22. The second leg members 21 extend upwardly and rearwardly from the front ends thereof. The distance between the left and right second leg members 21 is less than the distance between the left and right first leg members 11. The second cross bar 22 is formed with an insert hole 221 located at a central portion thereof.

The foldable bench 100 further includes left and right first pivot units 23. The left first pivot unit 23 interconnects the left first leg member 11 and the left second leg member 21. The right first pivot unit 23 interconnects the right first leg member 11 and the right second leg member 21. In this embodiment, each of the left and right first pivot units 23 includes a screw, and a nut engaged threadedly to the screw. However, the first pivot units 23 are not limited to such a configuration, and instead may include rivets or other kinds of connections that can permit relative movement between the first and second leg members 11, 21.

The backrest frame 3 is substantially U-shaped, and includes left and right backrest arms 31 having top and bottom ends, and a fourth cross bar 32 connected between the bottom ends of the backrest arms 31. That is, the bottom ends of the backrest arms 31 are connected respectively to two opposite ends of the fourth cross bar 32. The backrest arms 31 extend upwardly and rearwardly from the bottom ends thereof, and the top ends of the backrest arms 31 are higher than the first cross bar 12. The distance between the left and right backrest arms 31 is less than the distance between the left and right second leg members 21.

The foldable bench 100 further includes left and right second pivot units 33. The left second pivot unit 33 interconnects the left second leg member 21 and the left backrest arm 31. The right second pivot unit 33 interconnects the right second leg member 21 and the right backrest arm 31. Each of the left and right second pivot units 33 is located near the rear end of the respective second leg member 21 and the fourth cross bar 32.

Each of the left and right toggle mechanisms is connected between the first and second leg frames 1, 2, is stretchable to move the first and second leg frames 1, 2 to an unfolded position, and is foldable to permit the first and second leg frames 1, 2 to move to a folded position. Each of the left and right toggle mechanisms includes a first toggle member 4 disposed above an intersection of the first and second leg members 11, 21, and a second toggle member 4' disposed below the intersection of the first and second leg members 11, 21. Since the construction of the left and right toggle mechanisms is similar, only the right toggle mechanism will be described hereinafter. Each of the first and second toggle members 4, 4' interconnects the right first leg member 11 and the right second leg member 21. Each of the first and second toggle members 4, 4' includes a front section 41, 41', a rear section 42, 42', and a pivot pin 43, 43' interconnecting the front and rear sections 41, 41', 42, 42'. The front section 41 of the first toggle member 4 has a front end pivoted to the right first leg member 11 through a right third pivot unit 44. The rear section 42 of the first toggle member 4 has a rear end pivoted to the right second leg member 21 through the right second pivot unit 33 so that the right second pivot unit 33 interconnects pivotally the rear section 42 of the first toggle member 41, the right second leg member 21, and the right backrest arm 31. The front section 41' of the second toggle member 4' has a front end pivoted to the right second leg member 21 through a right fourth pivot unit 45. The rear section 42' of the second toggle member 4' has a rear end pivoted to the right first leg member 11 through a right fifth pivot unit 46.

The upper frame 5 is substantially U-shaped, and includes a top end having a third cross bar 52, left and right side sections 51, each having a top end and a bottom end, and two pivot connecting seats 53 fixed respectively to the top ends of the left and right side sections 51 near the third cross bar 52. The left and right side sections 51 extend downwardly and forwardly from the third cross bar 52. The top ends of the left and right backrest arms 31 are connected pivotally and respectively to the pivot connecting seats 53. The bottom ends of the left and right side sections 51 are connected pivotally and respectively to the left and right first leg members 11 proximate to the first cross bar 12. Each of the pivot connecting seats 53 includes two spaced-apart lug members 531 for receiving the top end of a respective one of the left and right backrest arms 31. The distance between the left and right side sections 51 is greater than the distance between the left and right first leg members 11.

The foldable bench 100 further includes left and right sixth pivot units 54, and left and right seventh pivot units 55. Each of the left and right sixth pivot units 54 passes through the lug members 531 of a respective one of the pivot connecting seats 53 and the top end of the respective one of the left and right backrest arms 31 so as to connect pivotally the backrest frame 3 to the upper frame 5. Each of the left and right seventh pivot units 55 passes through a respective one of the left and right side sections 51 and a respective one of the left and right first leg members 11 so as to connect pivotally a front end of the first leg frame 1 to the upper frame 5.

The seat frame 6 has a substantially U-shaped rod section 62 that curves rearwardly and that has two spaced-apart front ends connected pivotally and respectively to the left and right first leg members 11 of the first leg frame 1 proximate to the first cross bar 12 through a pair of eighth pivot units 61.

Figure 3:
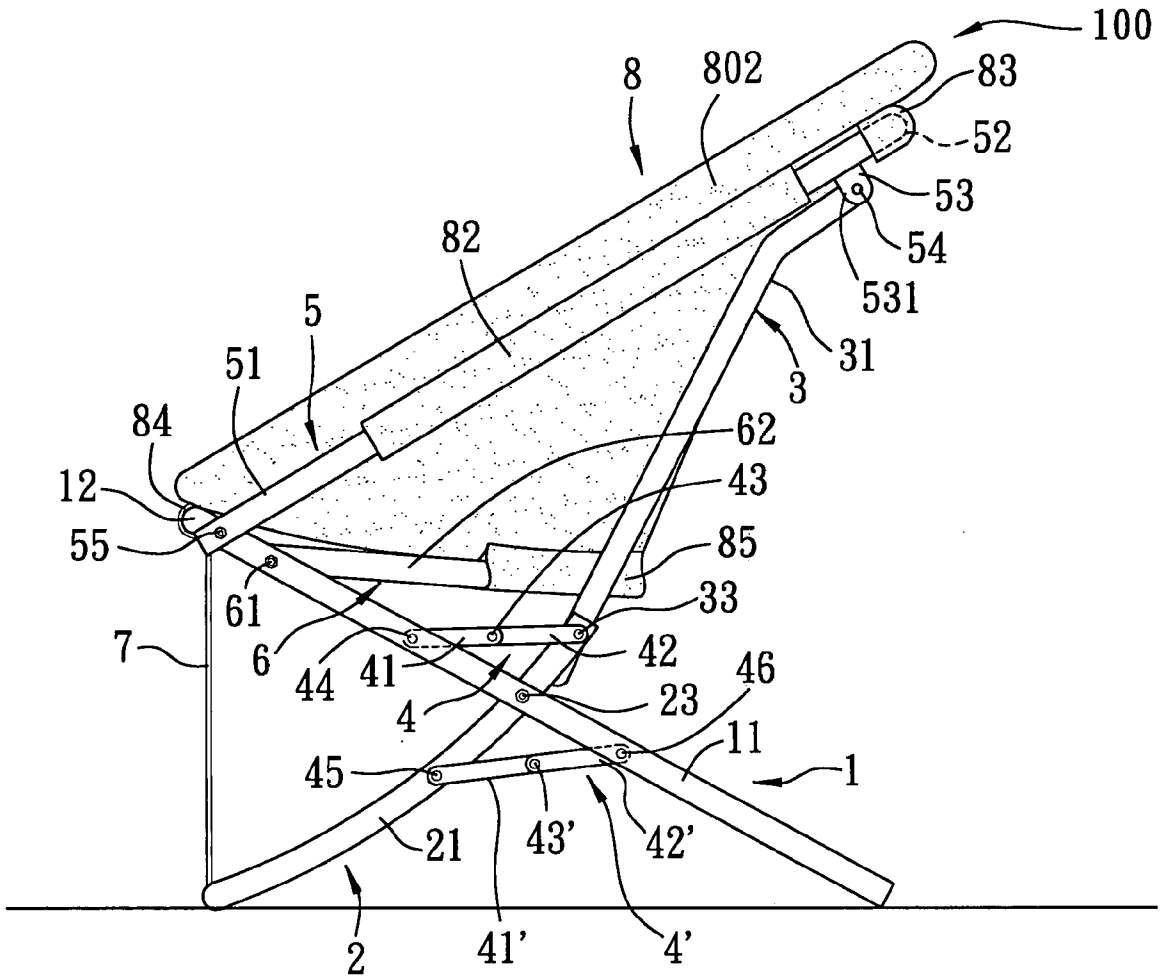
FIG. 3 is a schematic side view of the preferred embodiment.

The supporting rod 7 has a top pivot end 71 connected pivotally to the first cross bar 12, and a bottom insert end 72 engaged detachably to the second cross bar 22. The top pivot end 71 has a pivot hole 711 for extension of the pivot pin 13 therethrough when the top pivot end 71 is connected to the pivot pin 13, thereby allowing the supporting rod 7 to pivot about the pivot pin 13. The bottom insert end 72 is received releasably in the insert hole 221 in the second cross bar 22. In order to prevent separation of the top pivot end 71 from the pivot pin 13, an end of the pivot pin 13 is formed into a head after the top pivot end 71 is sleeved on the pivot pin 13. Alternatively, the pivot pin 13 may be configured as a screw, and a nut may be engaged threadedly to the screw after the top pivot end 71 is sleeved on the pivot pin 13. In this embodiment, the supporting rod 7 is a flat bar. However, the supporting rod 7 is not limited to such a configuration, and instead may be a rod having different cross sections. When the foldable bench 100 is in an unfolded state, as shown in FIG. 3, the supporting rod 7 is disposed between the first cross bar 12 and the second cross bar 22. When the foldable bench 100 is in a folded state, as shown in FIG. 7, the bottom insert end 72 is released from the insert hole 221 in the second cross bar 22, and the supporting rod 7 is folded and is disposed parallel to the first cross bar 12.

The flexible seat cushion assembly 8, in this embodiment, is a cushion body, and includes a flexible seat section 801 having a front end, a rear end, and left and right lateral parts extending between the front and rear ends of the seat section 801, and a flexible backrest section 802 connected to the rear end and the left and right lateral parts of the seat section 801. The seat frame 6 extends rearwardly near a bottom side of the seat section 801. The seat cushion assembly 8 further includes left and right side sleeves 82, a rear sleeve 83, a front sleeve 84, and a bottom sleeve 85. The left and right side sleeves 82 are connected to the backrest section 802 near the left and right lateral parts of the seat section 801, and are sleeved respectively on the left and right side sections 51 of the upper frame 5. The rear sleeve 83 is connected to a top end part of the backrest section 802, and is sleeved on the third cross bar 52. The front sleeve 84 is connected to the front end of the seat section 801, and is sleeved on the first cross bar 12. The bottom sleeve 85 is connected to the backrest section 802 adjacent the rear end and the left and right lateral parts of the seat section 801, and is sleeved on the U-shaped rod section 62 of the seat frame 6. Therefore, the seat cushion assembly 8 is stably supported among the upper frame 5, the seat frame 6, and the first leg frame 1.

Figure 2:
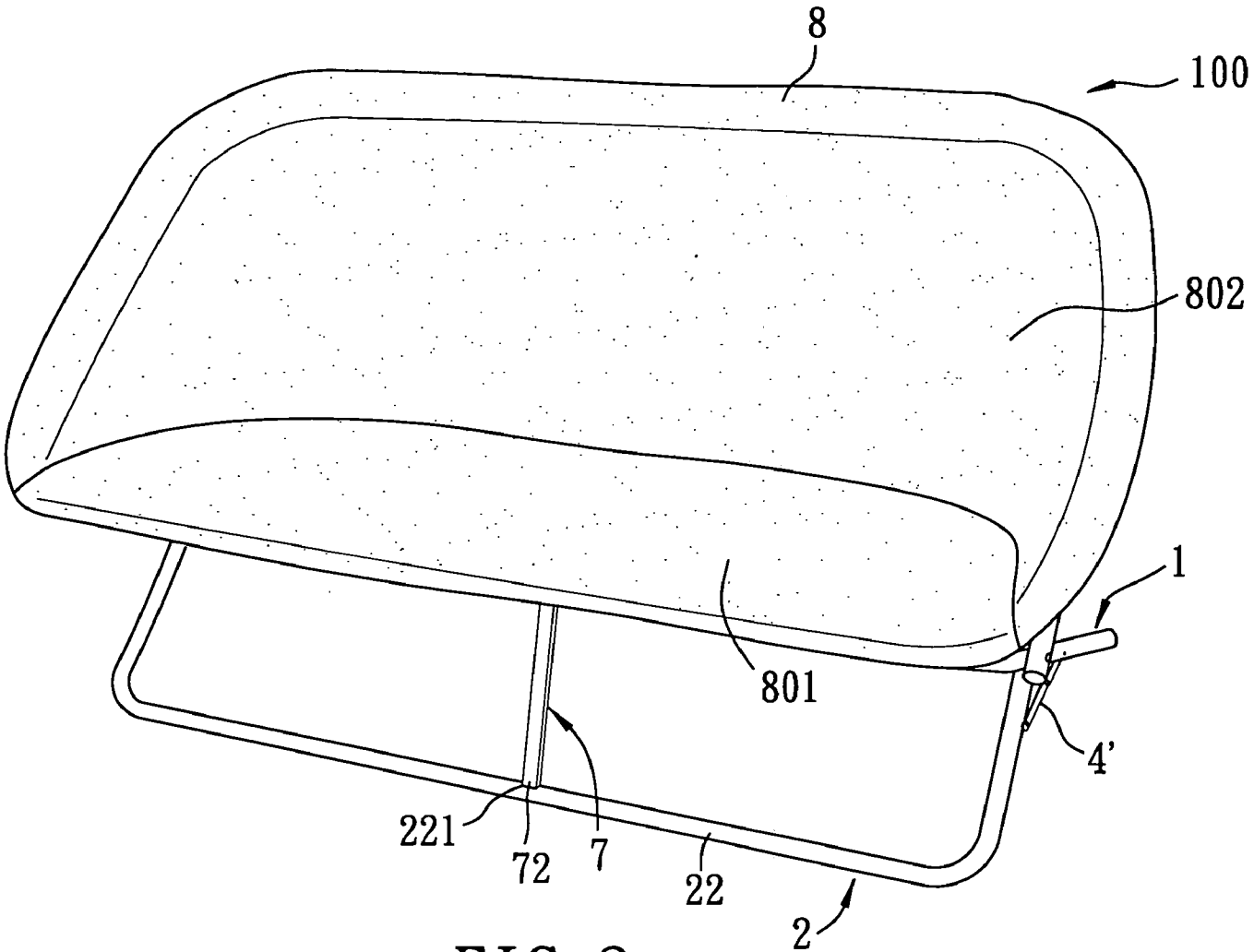
FIG. 2 is a perspective front view of the preferred embodiment of a foldable bench according to the present invention.
Figure 4:
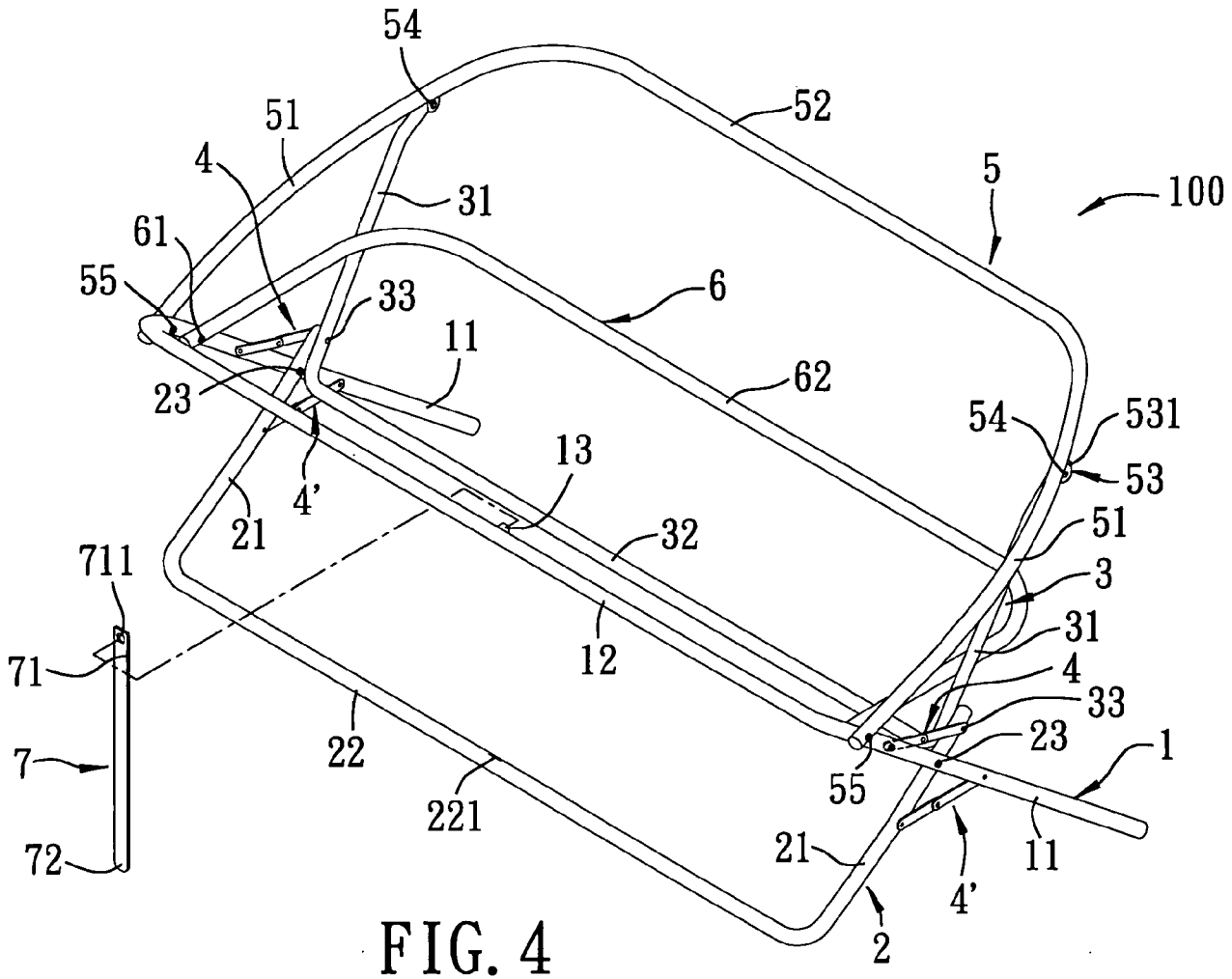
FIG. 4 is a view similar to FIG. 2, but without a seat cushion assembly to better illustrate structural features of the preferred embodiment.

As best shown in FIGS. 2, 3 and 4, when the foldable bench 100 is disposed in the unfolded state, the first and second leg frames 1, 2 are pivoted to form fixed predetermined angles therebetween through the securing actions of the first and second toggle members 4, 4' of the left and right toggle mechanisms, and the front ends of the first leg members 11 and the top ends of the backrest arms 31 are maintained stably in an unfolded position through connections with the upper frame 5. The supporting rod 7 is pivoted downwardly about the pivot pin 13, and the bottom insert end 72 is engaged with the insert hole 221 in the second cross bar 22 so that a supporting structure of the first cross bar 12 is strengthened.

Figure 5:
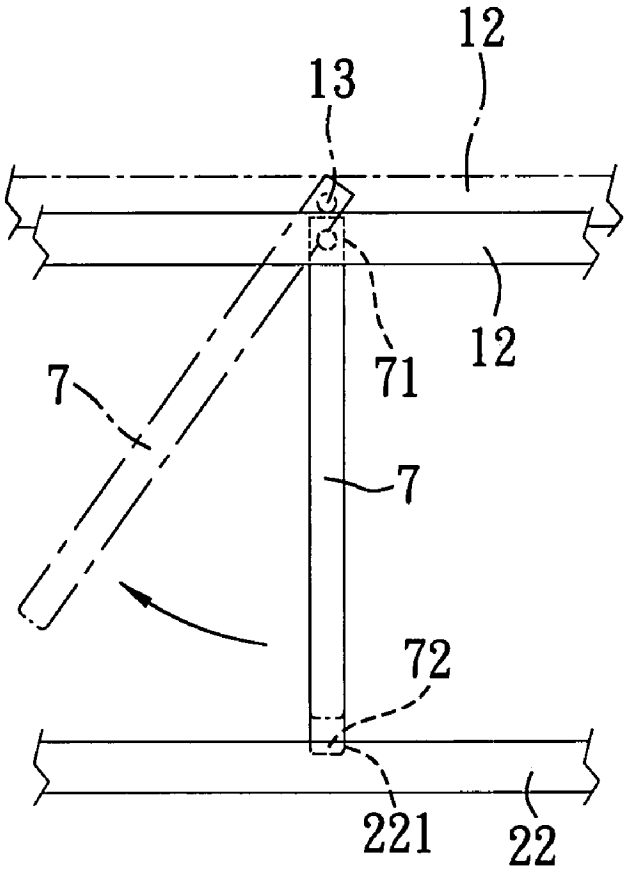
FIG. 5 is a fragmentary schematic front view of the preferred embodiment, illustrating how a supporting rod is detachably connected to a second cross bar.
Figure 6:
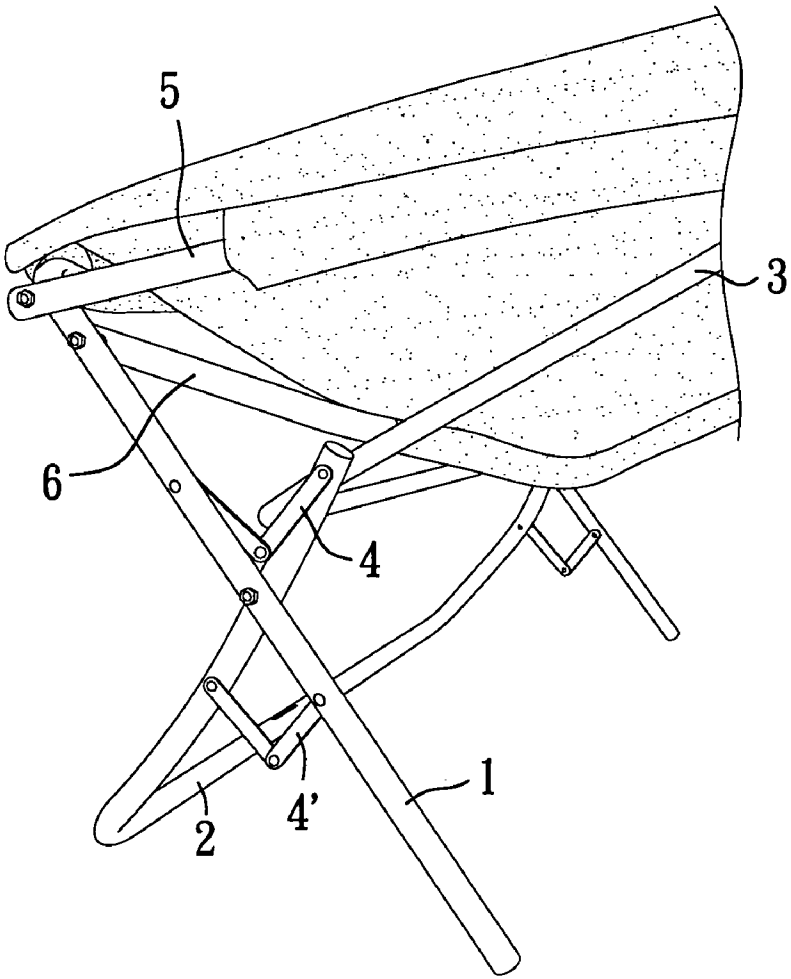
FIG. 6 is a fragmentary perspective view of the preferred embodiment, illustrating how first and second toggle members are bent to permit folding of first and second leg frames.
Figure 7:
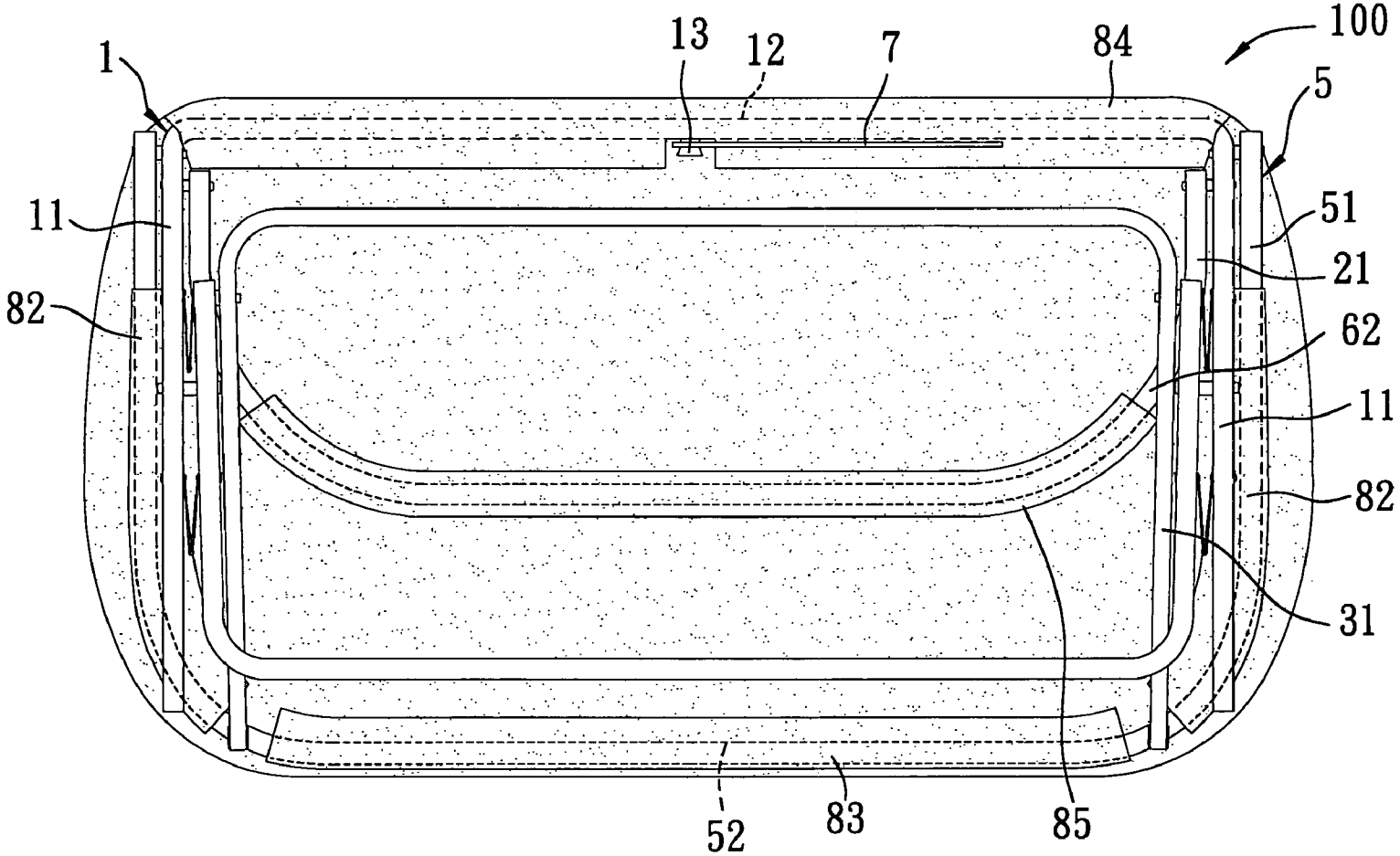
FIG. 7 is a schematic bottom view of the preferred embodiment in a folded state.

Referring to FIGS. 5, 6 and 7, when folding of the foldable bench 100 is desired, the first cross bar 12 is first lifted slightly so as to disengage the bottom insert end 72 of the supporting rod 7 from the insert hole 221 in the second cross bar 22, after which the supporting rod 7 is pivoted about the pivot pin 13 to a position parallel to the first cross bar 12. Next, the first and second toggle members 4, 4' of the left and right toggle mechanisms are pressed downwardly so that the front ends of the second leg members 21 pivot rearwardly. In this state, a user manipulates the foldable bench 100 until the first and second leg frames 1, 2 are parallel to each other. During the folding operation, the upper frame 5, the seat frame 6, and the backrest frame 3 also move gradually to a folded position, as shown in FIG. 7.

The foldable bench 100 of the present invention is foldable to a flat state, as shown in FIG. 7, so that it is very convenient to transport, move, and store.

It should be noted that additional supporting rods 7 may be disposed between the first cross bar 12 and the second cross bar 22 depending on the length of the foldable bench 100 so as to enhance the supporting force of the first cross bar 12. Further, the foldable bench 100 may be provided with only one toggle member 4 or 4' for each of the left and right toggle mechanisms.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A foldable bench comprising:

a first leg frame including a front first cross bar, said first leg frame extending downwardly and rearwardly from said first cross bar;

a second leg frame including a front second cross bar disposed below said first cross bar, said second leg frame extending upwardly and rearwardly from said second cross bar and being connected pivotally to and intersecting said first leg frame;

a backrest frame connected pivotally to a top end of said second leg frame and extending upwardly and rearwardly from said second leg frame, said backrest frame having a top end higher than said first cross bar;

left and right toggle mechanisms, each of which is connected between said first and second leg frames, each of said toggle mechanisms being stretchable to move said first and second leg frames to an unfolded position and being foldable to permit said first and second leg frames to move to a folded position;

an upper frame connected to a top end of said first leg frame proximate to said first cross bar and to said top end of said backrest frame, said upper frame extending upwardly and rearwardly from said first cross bar;

a supporting rod having a top pivot end connected pivotally to said first cross bar, and a bottom insert end engaged detachably to said second cross bar, said bottom insert end being releasable from said second cross bar to place said first and second leg frames in said folded position; and a flexible seat cushion assembly mounted on said upper frame and said first cross bar.

2. The foldable bench as claimed in claim 1, wherein each of said left and right toggle mechanisms includes a first toggle member disposed above an intersection of said first and second leg frames, and a second toggle member disposed below the intersection of said first and second leg frames.

3. The foldable bench as claimed in claim 1, wherein said seat cushion assembly includes a flexible seat section having a front end, a rear end, and left and right lateral parts extending between said front and rear ends of said seat section, and a flexible backrest section connected to said rear end and said left and right lateral parts of said seat section.

4. The foldable bench as claimed in claim 3, further comprising a seat frame connected pivotally to said first leg frame proximate to said first cross bar and extending rearwardly near a bottom side of said seat section, said seat cushion assembly further including a bottom sleeve that is sleeved on said seat frame.

5. The foldable bench as claimed in claim 4, wherein said first leg frame further includes left and right first leg members, said second leg frame further including left and right second leg members connected pivotally and respectively to said left and right first leg members.

6. The foldable bench as claimed in claim 4, wherein said upper frame includes a top end having a third cross bar, and left and right side sections extending downwardly and forwardly from said third cross bar, said left and right side sections having bottom ends connected pivotally and respectively to said first leg members proximate to said first cross bar.

7. The foldable bench as claimed in claim 6, wherein said seat cushion assembly further includes left and right side sleeves connected to said backrest section near said left and right lateral parts of said seat section and sleeved respectively on said left and right side sections of said upper frame, a rear sleeve connected to a top end part of said backrest section and sleeved on said third cross bar, and a front sleeve connected to said front end of said seat section and sleeved on said first cross bar.

8. The foldable bench as claimed in claim 7, wherein said backrest frame includes left and right backrest arms having top ends connected pivotally and respectively to said left and right side sections of said upper frame near said third cross bar, and a fourth cross bar connected between bottom ends of said backrest arms.

9. The foldable bench as claimed in claim 1, wherein said first leg frame further includes a pivot pin that projects from said first cross bar in a front-to-rear direction and that is connected to said top pivot end of said supporting rod so as to permit pivoting movement of said supporting rod about said pivot pin, said second cross bar including an insert hole for receiving releasably said bottom insert end of said supporting rod.

* * * * *